US007256706B2

(12) United States Patent
Haase et al.

(10) Patent No.: US 7,256,706 B2
(45) Date of Patent: Aug. 14, 2007

(54) HYBRID WELL COMMUNICATION SYSTEM

(75) Inventors: Mark Christopher Haase, Rijswijk (NL); John Foreman Stewart, Rijswijk (NL)

(73) Assignee: Shell Oil Company, Houston, TX (US)

( * ) Notice: Subject to any disclaimer, the term of this patent is extended or adjusted under 35 U.S.C. 154(b) by 722 days.

(21) Appl. No.: 10/204,610

(22) PCT Filed: Feb. 23, 2001

(86) PCT No.: PCT/EP01/02155

§ 371 (c)(1),
(2), (4) Date: Aug. 22, 2002

(87) PCT Pub. No.: WO01/63804

PCT Pub. Date: Aug. 30, 2001

(65) Prior Publication Data

US 2003/0020631 A1 Jan. 30, 2003

(30) Foreign Application Priority Data

Feb. 25, 2000 (EP) ..... 00200672

(51) Int. Cl.
*G01V 3/00* (2006.01)

(52) U.S. Cl. ..... 340/854.3; 340/854.6; 340/864.7; 166/313

(58) Field of Classification Search ..... 340/853.1, 340/853.6, 853.7, 854.6, 854.7, 855.5; 166/50, 166/64, 65.1, 313
See application file for complete search history.

(56) References Cited

U.S. PATENT DOCUMENTS

| | | | | |
|---|---|---|---|---|
| 3,939,348 | A * | 2/1976 | Barrett | 250/339.13 |
| 4,216,536 | A * | 8/1980 | More | 367/83 |
| 4,893,644 | A | 1/1990 | Giacomini | |
| 5,706,896 | A | 1/1998 | Tubel et al. | |
| 5,721,538 | A * | 2/1998 | Tubel et al. | 340/853.4 |
| 5,745,047 | A * | 4/1998 | Van Gisbergen et al. | 340/853.1 |
| 5,831,549 | A * | 11/1998 | Gearhart | 340/853.1 |
| 5,941,307 | A | 8/1999 | Tubel | |
| 5,955,966 | A * | 9/1999 | Jeffryes et al. | 340/853.1 |
| 5,986,749 | A * | 11/1999 | Wu et al. | 356/73.1 |
| 6,125,935 | A * | 10/2000 | Shahin, Jr. | 166/250.14 |
| 6,241,028 | B1 * | 6/2001 | Bijleveld et al. | 175/40 |
| 6,271,766 | B1 * | 8/2001 | Didden et al. | 340/853.1 |
| 6,464,011 | B2 * | 10/2002 | Tubel | 166/313 |
| 2002/0066309 | A1 * | 6/2002 | Tubel et al. | 73/152.54 |

FOREIGN PATENT DOCUMENTS

EP 0 881 787 12/1998

(Continued)

OTHER PUBLICATIONS

PCT Search Report, EP, Dec. 15, 1999.

*Primary Examiner*—Timothy Edwards, Jr.
(74) *Attorney, Agent, or Firm*—Rachael A. Stiegel

(57) ABSTRACT

A hybrid, hardwired and wireless well communication system having a fiber optical, electrical or other signal transmission conduit extending from the wellhead into the well and one or more wireless signal transducers that are located at a distance from the conduit and transmit wireless signals to one or more signal converters which are coupled to the conduit, and which are located near branchpoints of a multilateral well.

10 Claims, 1 Drawing Sheet

FOREIGN PATENT DOCUMENTS

| | | | |
|---|---|---|---|
| EP | 0 646 304 | | 5/1999 |
| EP | 0 918136 | A1 | 5/1999 |
| EP | 0 972 909 | A2 | 1/2000 |
| GB | 2339902 | | 2/2000 |
| GB | 2340520 | | 2/2000 |
| GB | 2340580 | | 2/2000 |
| NO | 993898 | | 5/2000 |
| RU | 2117934 | | 8/1998 |
| WO | 93 26115 | | 12/1993 |
| WO | 98 50673 | | 11/1998 |

* cited by examiner

HYBRID WELL COMMUNICATION SYSTEM

FIELD OF THE INVENTION

The invention relates to a hybrid well communication system and more in particular to a downhole system for transmitting signals in a hydrocarbon fluid production well.

BACKGROUND OF THE INVENTION

Currently known well communication systems are either hardwired or wireless systems. Wireless systems are disclosed in U.S. Pat. Nos. 4,893,644 and 5,706,896 and in European patent No. 646304 and have the disadvantage that the acoustic or electromagnetic signals transmitted through the well tubulars and/or fluids passing therethrough can only convey a limited datastream through the well and that the signal to noise level of the transmitted datastreams is low.

Hardwired downhole communication systems are able to transmit large datastreams with a high signal to noise level, but are extremely expensive and difficult to install and/or to modify and maintain after installation, in particular if the well is a multilateral well and the wires need to extend into different well branches.

The system according to the preamble of claim 1 is known from UK patent application GB 2340520. This prior art reference discloses an unbranched well having a horizontal inflow section in which a series of wireless signal transmitters transmit signals in a bucket-brigade mode to a signal receiver at the bottom of the vertical upper part of the well, where the received signal is transmitted via a signal transmission cable.

The known wireless signal transmitters transmit relatively weak acoustic or electromagnetic signals through the produced well fluids, which requires the use of a series of transmitters along the length of the horizontal inflow region of the well. Such an arrangement would be impractical in a multilateral well since the signals transmitted in different well branches would interfere with each other.

The present invention aims to alleviate the disadvantages of the known system and to provide a cost effective and flexible well communication system which is able to transmit large datastreams at a high signal to noise ratio and which can be adapted easily after installation to changing circumstances and to various types of equipment that may be installed during the lifetime of a well, in case the well is a multilateral well and one or more well branches are added after drilling and completion of the original well in which a communication system has already been installed.

SUMMARY OF THE INVENTION

The well communication system according to the invention comprises:

- a signal transmission conduit for transmitting signals between a control unit at or near the earth surface and a downhole signal converter;
- a downhole measuring and/or control assembly, which is equipped with a wireless signal transducer; and
- wherein said signal converter and signal transducer are located at different depths in the well and form a wireless communication link between said converter and transducer, and
- the well is a multilateral well comprising a main wellbore and one or more wellbranches;
- the signal transmission conduit extends from the wellhead into the main wellbore;

- at least one signal converter is located at or near a downhole branchpoint; and
- a measuring and/or control assembly, which is equipped with a wireless signal transducer is located in at least one wellbranch away from the branchpoint.

In such case the fiber optical or electrical signal transmission conduit in the main wellbore may serve as a back gone for the downhole communication network and a plurality of wireless radio communication links may form flexible extensions of the network which allow the downhole measuring and control equipment to be deployed and/or removed without requiring installation of additional wiring and making of cable connections downhole.

The signal transmission cable may be an electric or fiber optical cable. In the latter case the signal converter may comprise a piezo-electric or electro mechanical signal transmitter at a well branchpoint and ar acoustic sensor based on fiber-bragg or Fabry-Perot type sensor which is embedded in the fiber optical cable near said well branchpoint which transducer is adapted to transmit modulated acoustic waves to the acoustic sensor in response to wireless signals transmitted by the downhole wireless signal transducer. Alternately, the signal converter may comprise of an electro-optic converter wherein electrical signals are converted to modulated light and guided onto a single optical fiber and sent to the surface. Modulated optical signals from the surface are received by the signal converter, separated into distinct wavelength components using filters or diffraction gratings. The multiple wavelengths are then caused to fall on an array of optical detectors spaced according to the individual wavelengths to be detected and decoded. The multiple decoded signals are then encoded, multiplexed and transmitted to the downhole measuring and control equipment.

BRIEF DESCRIPTION OF THE DRAWINGS

The invention will be described in more detail with reference to the accompanying drawings, in which:

Referring now to FIG. 1 there is shown a multilateral well having a main wellbore 1 and a branch wellbore 2, which wellbores intersect at a branchpoint 3.

DETAILED DESCRIPTION OF INVENTION

Figure 1:
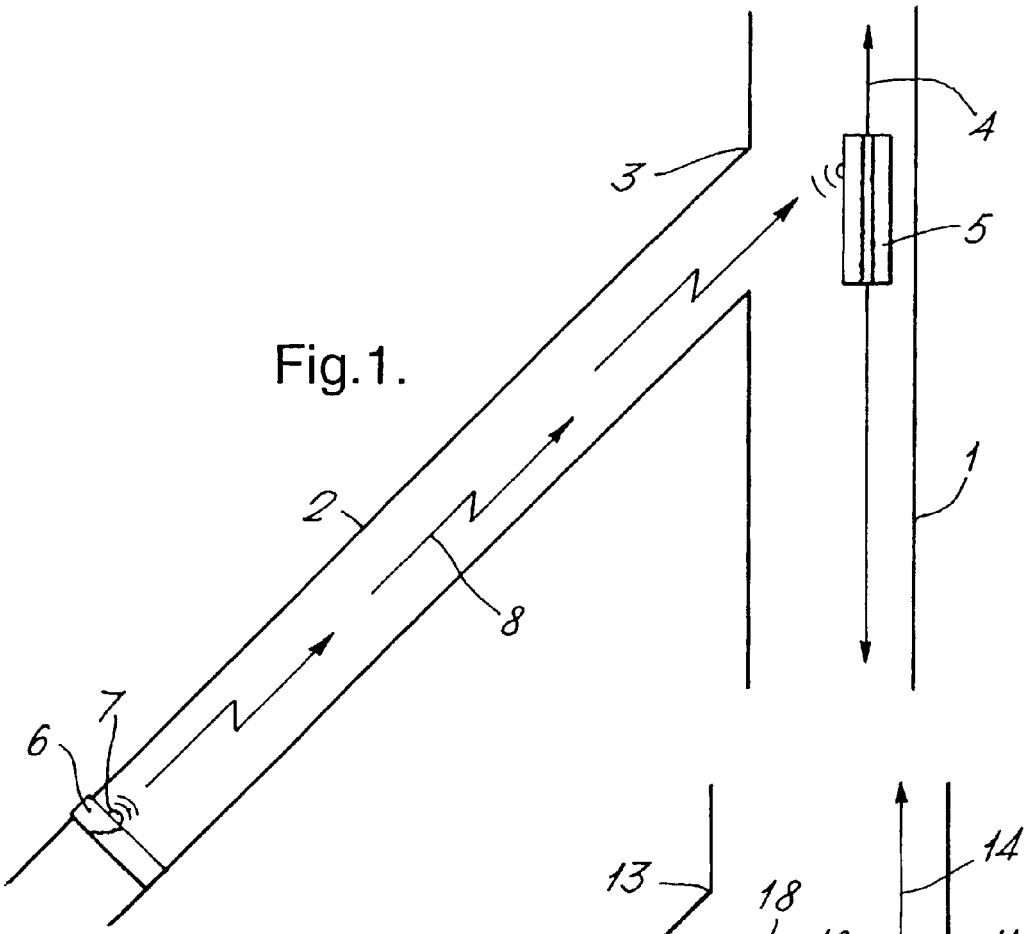
FIG. 1 shows a multilateral well equipped with a hybrid well communication system according to the invention.

The main wellbore is equipped with an electrical or fiber optical signal transmission conduit 4. This conduit 4 may be permanently embedded in a cement lining around a well casing or be arranged in an annular space surrounding a production tubing or be arranged inside a production tubing or liner as is illustrated in the drawing.

At the branchpoint 3 the conduit 4 is equipped with a signal converter 5. The branch wellbore 2 contains measuring and/or control equipment 6, such as a flowmeter, valve, formation or seismic sensor, which is equipped with a wireless signal transmitter 7.

The signal converter 5 and signal transmitter are each adapted to transmit and receive electromagnetic radiofrequency signals and thus form a wireless link 8 along a substantial part of the length of the branch wellbore 2. The signal converter 5 converts any wireless signals received from the transmitter 7 into equivalent electric or optical signals that are then transmitted via the conduit 4 to a measuring and control station (not shown) at the wellhead (not shown) and vice versa.

Figure 2:
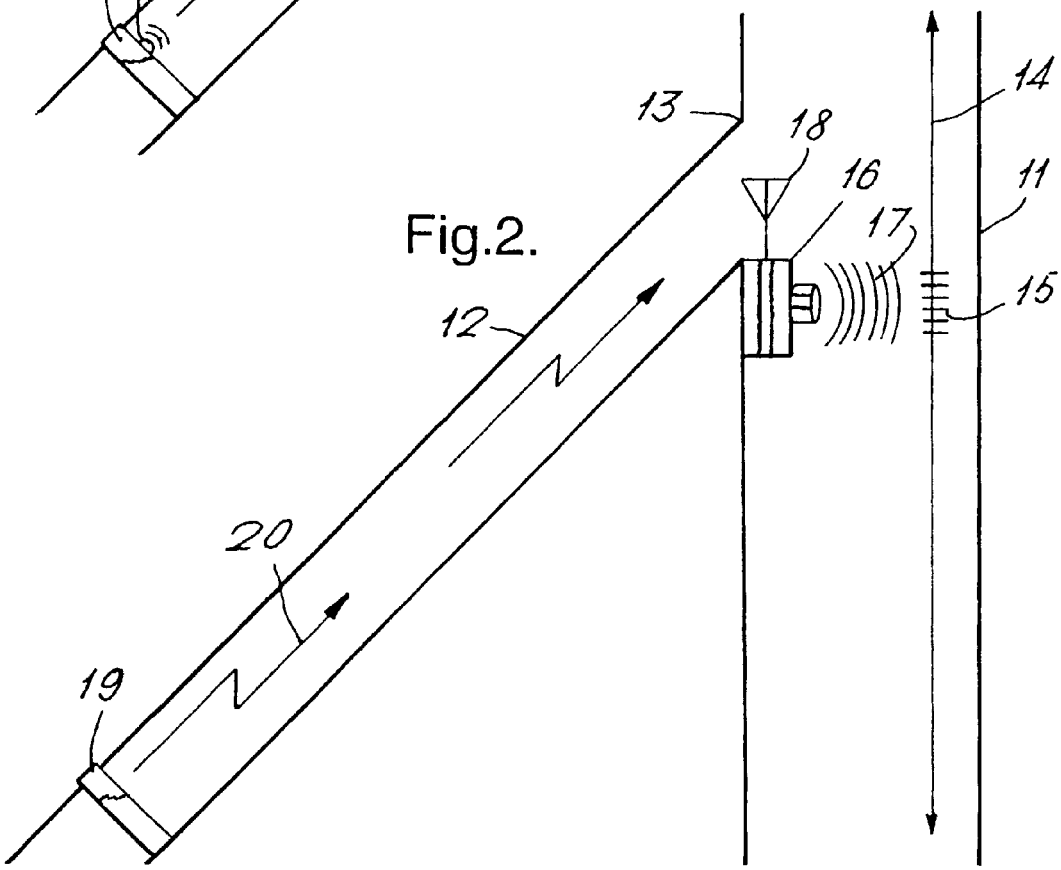
FIG. 2 shows a multilateral well equipped with an alternative embodiment of a hybrid well communication system according to the invention.

Referring now to FIG. 2 there is shown a multilateral well having a main wellbore 11 and a branch wellbore 12 which intersect at a branchpoint 13.

A fiber optical cable 14 extends through the main wellbore 11 and is equipped with multiple fiber bragg gratings 15 near the branchpoint 13, which gratings 15 reflects light with wavelengths equal to the gratings width while all light of differing wavelengths continues to travel through the fiber optical conduit 14.

A piezo-electric transducer 16 is located at the branchpoint 13 and transmits modulated acoustic waves 17 to the fiber bragg gratings 15, which initiates variations in the wavelengths of the optical signal reflected thereby.

The piezo-electric transducer 16 is equipped with an antenna 18 which receives electromagnetic signals transmitted by a signal transmitter 19, such that the transducer 16 and transmitter 19 form a wireless electromagnetic link 20 in the branch wellbore 12. The transducer 16 and fiber bragg gratings 15 form a wireless acoustic communication link at the branchpoint 13, whereas the fiber optical cable 14 forms the hardwired; communication link in the main wellbore 11. Various wellbranches may be equipped with wireless communication links as described hereinbefore which may be linked to the fiber optical cable with various piezo-electric transducers 16.

In the event that the signal converter is optically connected to the fiber optic cable (or electrical cable), optical signals may be separated into a plurality of constituent wavelength components using appropriate filters, mirrors and diffraction gratings. The multiple wavelengths are then caused to fall on an array of optical detectors spaced according to the individual wavelengths to be detected and decoded. The multiple decoded signals are than encoded, multiplexed and transmitted to the downhole measuring and control equipment.

We claim:

1. A downhole communication system for transmitting signals in a hydrocarbon fluid product well, the system comprising:

a control unit at or near the earth surface;

a downhole signal converter a signal transmission conduit for transmitting signals between said control unit and said downhole signal converter;

a downhole measuring and control assembly, which is equipped with a wireless signal transducer, and wherein;

said signal converter and said signal transducer are located at different depths in the well and form a wireless communication link there between;

the well is a multilateral well comprising a main wellbore and one or more wellbranches;

the signal transmission conduit extends from the wellhead into the main wellbore;

at least one signal converter is located at or near a downhole branchpoint; and said downhole measuring and control assembly is located in at least one wellbranch away from the branchpoint; said signal transducer and said signal converter forming a wireless link along a substantial part of the length of said wellbranch.

2. The system of claim 1, wherein the multilateral well comprises a plurality of wellbranches, which each contain a measuring and control assembly which is equipped with a wireless signal transducer and wherein the signal transmission conduit comprises a plurality of downhole signal converters, which are located at or near the well branchpoints.

3. The system of claim 1, wherein the signal transmission conduit is a fiber optical cable.

4. The system of claim 3, wherein the downhole signal converter is adapted for converting wireless signals into optical signals that are transmitted through the fiber optical cable and vice versa.

5. The system of claim 4, wherein the signal converter comprises a piezo-electric signal transmitter at a well branchpoint and a fiber-bragg or fabry-perot acoustic sensor which is embedded in the fiber optical cable near said well branchpoint which transducer is adapted to transmit modulated acoustic waves to the acoustic sensor in response to wireless signals transmitted by the down hole wireless signal transducer.

6. The system of claim 4, wherein the signal converter comprises an integrated electro optic device that is directly connected to the fiber optic cable.

7. The system of claim 1, wherein the down hole signal transducer and converter are adapted to communicate with each other via transmission of electromagnetic signals.

8. The system of claim 1, wherein the signal transmission cable is an electric cable.

9. The system of claim 7, wherein the downhole signal transducer and converter are adapted to communicate with each other via transmission of electromagnetic signals through the wall of a branch well tubular that extends through at least part of the length of the branch well.

10. The system of claim 9, wherein the branch well tubular is electrically isolated from the casing and/or other well tubulars that are arranged in the main wellbore.

* * * * *